US008368306B2

(12) United States Patent
Hooker et al.

(10) Patent No.: US 8,368,306 B2
(45) Date of Patent: Feb. 5, 2013

(54) SHORT ARC DIMMABLE HID LAMP WITH CONSTANT COLOUR DURING DIMMING

(75) Inventors: James Hooker, Scotland (GB); Lode Derhaeg, Diest (BE)

(73) Assignee: Flowil International Lighting (Holding) BV, Amsterdam (NL)

( * ) Notice: Subject to any disclaimer, the term of this patent is extended or adjusted under 35 U.S.C. 154(b) by 0 days.

(21) Appl. No.: 13/082,594

(22) Filed: Apr. 8, 2011

(65) Prior Publication Data

US 2011/0248630 A1 Oct. 13, 2011

(30) Foreign Application Priority Data

Apr. 8, 2010 (IN) ..... 867/DEL/2010

(51) Int. Cl.
*H01J 17/20* (2006.01)

(52) U.S. Cl. ..... 313/640; 313/637

(58) Field of Classification Search ..... 313/636, 313/637, 639, 640
See application file for complete search history.

(56) References Cited

U.S. PATENT DOCUMENTS

| | | | | |
|---|---|---|---|---|
| 5,635,796 | A * | 6/1997 | Genz | 313/641 |
| 6,819,050 | B1 | 11/2004 | Zhu et al. | |
| 2002/0003391 | A1 * | 1/2002 | Tsuda et al. | 313/318.01 |
| 2002/0135304 | A1 * | 9/2002 | Honda et al. | 313/634 |
| 2004/0217710 | A1 * | 11/2004 | Zhu et al. | 313/639 |
| 2005/0073257 | A1 * | 4/2005 | Takeuchi et al. | 313/634 |
| 2006/0049765 | A1 * | 3/2006 | Ota et al. | 313/638 |
| 2006/0255741 | A1 | 11/2006 | Ishigami et al. | |
| 2007/0018581 | A1 | 1/2007 | Domae et al. | |

FOREIGN PATENT DOCUMENTS

| | | |
|---|---|---|
| DE | 8505119 | 6/1987 |
| DE | 10234758 | 12/2004 |

OTHER PUBLICATIONS

European Search Report dated Nov. 4, 2011 from corresponding European Application No. EP2375439.

* cited by examiner

*Primary Examiner* — Anh Mai
*Assistant Examiner* — Andrew Coughlin
(74) *Attorney, Agent, or Firm* — Wolf, Greenfield & Sacks, P.C.

(57) ABSTRACT

The present disclosure relates to a short arc metal halide lamp without outer jacket, whose arc tube has a specified aspect ratio and chemical filling, characterized in that it delivers a low color temperature and very high color rendering index, which are maintained during dimming.

10 Claims, 3 Drawing Sheets

100

SHORT ARC DIMMABLE HID LAMP WITH CONSTANT COLOUR DURING DIMMING

TECHNICAL FIELD

The present invention relates to a short arc HID (high intensity discharge) lamp, in general, and particularly to single ended short arc metal halide dimmable HID (high intensity discharge) lamp with constant colour during dimming.

DESCRIPTION OF THE RELATED ART

Light sources for photographic lighting are produced in two different color temperatures, 5600K to suit the daylight film stock used for outdoor shooting and 3200K to suit the Tungsten film stock used for indoor lighting. The 5600K light is produced by high intensity metal halide lamps of the quartz short arc variety. The 3200K light until now is produced almost exclusively by Tungsten halogen lamps since it has not been possible to fabricate a short arc quartz metal halide lamp of such low colour temperature in single ended version which also remains stable during life. This is unfortunate because the life of such halogen lamps is rather short, their luminous efficacy is very low and they produce tremendous amounts of unwanted infrared radiation. In order to realize a 3200K HID lamp, sodium is necessary in the chemical fill of the arc tube. While this is well known in general lighting lamps, it has not been possible to fabricate a lamp suitable for photo/projection services because of very high power loading, in which colour temperature and lamp voltage will increase rapidly due to sodium loss and lamp life would be extremely short.

The problem has been partially solved in the prior art by the use of ceramic tube materials instead of quartz. However, these have the major drawback of being translucent, but not optically transparent enough, and are therefore not suitable for short arc lamps of the type claimed here. The diffuse nature of the ceramic material scatters light excessively and makes them unsuitable for use in optical projection apparatus.

Additionally, the power loading with ceramic arc tubes is limited and they exist only up to 400 W. Much higher wattages are required for optical projection applications.

German patent DE10234758 relates to a metal halogen vapor lamp which has comparable good colour characteristics, in particular, regarding lamp-to-lamp colour variations and colour stability over life comparable to the metal halogen vapor lamps with ceramic wall material of the discharge vessel. The good results were achieved with the three-component system of a mixture of NaI, ScI3 and HoI3, whereby can become whole omitted in the however not whole optimum border line of a two-component system also HoI3. This patent does not talk about dimming.

Japanese patent JP6084496 relates to the high pressure metal vapor discharge lamp which encloses metal halides chosen so as to reduce colour shift during modulation of the light output. During dimming of a conventional metal halide lamp comprising a sodium-scandium halide fill plus mercury, the colour shifts owing to the relative change in vapour pressures of mercury Vs sodium-scandium halides. In a dimmed state there is proportionally less halide radiation and an increased mercury radiation, resulting in an undesirable increase of colour temperature. This patent teaches that by substituting mercury by xenon gas, the radiated light colour remains more stable during dimming. By consequence of its mercury-free design this lamp requires special control gear and a very high operating pressure. The luminous efficacy is inferior compared to mercury-containing lamps.

U.S. Pat. No. 6,819,050 describes high intensity ceramic metal halide lamps. It provides an arc discharge metal halide lamp for use in selected lighting fixtures having a discharge chamber with electromagnetic radiation or visible light permeable walls of a selected shape bounding a discharge region through which walls a pair of electrodes are supported in the discharge region spaced apart from one another. In this patent, the burner is made of ceramic material. The lamp described is not suitable for photo-optic applications because it relies on a ceramic discharge vessel, whose light scattering nature increases the effective dimensions of the light source.

U.S. Pat. No. 7,423,380 relates to a technology for obtaining a desired color characteristic as well as preventing thin tubes from cracking, in a ceramic metal halide lamp capable of being dimmed. It provides a dimmable metal halide lamp that is prevented from non-lighting due to leakage of an arc tube attributable to a crack occurring at thin tubes, as well as realizing a desired color characteristic, wherein the metal halide lamp includes rare earth metal halide, sodium halide, and magnesium halide, the rare earth metal halide being at least one of dysprosium halide, thulium halide, holmium halide, cerium halide, and praseodymium halide, and the magnesium halide being at least one of magnesium iodide and magnesium bromide. The teachings of said patent are suitable for Wattage from 70 to 250 W.

Publication no JP634443 discloses photo optical lamp with a fill based on Hafnium, Zirconium, Tin, Tantalum and Antimony. This lamp has a high colour temperature of >5000K and is therefore not suitable to replace 3200K tungsten halogen lamps.

In the prior art, it had been very difficult to achieve a very high colour rendering index such as is provided by tungsten halogen lamps, combined with the very high efficacy of existing daylight colour metal halide lamps, and in all cases the light output would shift to unacceptably high colour temperature when dimmed.

With all the above discussed restrictions or limitations, it is essential to have a short arc HID lamp having a low correlated colour temperature of about 3200K, which is capable of maintaining the same during dimming.

OBJECTS

The principal object of the present disclosure is to provide a short arc dimmable HID lamp with constant colour.

Another object of the present disclosure is to provide short arc dimmable HID lamp with constant colour during dimming.

Another object of the present disclosure is to increase the useful life, lamp efficacy and reduction in heat output by comparison to tungsten halogen lamps.

Yet another object of the present disclosure is to provide short arc dimmable HID lamp with constant colour which produces high CRI Still another object of the present disclosure is to provide short arc dimmable HID lamp with low color temperature.

In order to meet the requirements of a suitable alternative to 3200K tungsten halogen lamps employed in film and studio lighting, a high efficacy metal-halide based version should offer light of the same correlated colour temperature combined with a very high colour rendering index in excess of Ra90, and ideally also be able to maintain these two properties when the power dissipated by the lamp is reduced so as to attenuate its luminous flux

SUMMARY

In order to overcome the above mentioned problems and to achieve said objects, the present disclosure provides a single ended short arc metal halide lamp, whose arc tube has an aspect ratio of ≧1.1 and is equipped with at least one tungsten electrode. According to the disclosure, the arc tube geometry along with an arc tube chemical mix in a high loaded single ended short arc lamp realizes very high colour rendering index, low colour temperature and constant colour during dimming.

In a preferred embodiment of the present disclosure, the arc tube (discharge vessel) is in ellipsoidal form with a seal equipped at the two ends of the discharge vessel in each case, wherein the discharge vessel comprises a pair of tungsten electrodes with a free end longitudinal along the axis of symmetry projected into the interior of the arc tube (discharge vessel) from each seal wherein each electrode is sealed in a vacuum tight fashion by a foil of molybdenum, this assembly being encapsulated by and hermetically sealed into the quartz containment. The arc tube is filled with a chemical mix which comprises at least the iodides and/or bromides of Sodium, Scandium, Holmium (Na—Sc—Ho) and optionally Tl and iodides or bromides of Hg. The electrical loading of the lamp is in excess of 50 watts per millimetre of arc length.

The chemical mix is in the range of 0.75-2 wt % $HoX_3$, 45-85 wt % NaX, 1.5-5.5 wt % $ScX_3$, 0.1-1 wt % TlX and 10-50 wt % $HgX_2$, where X can be Br or I.

The chemical mix is in the preferable range of 1.0-1.5 wt % $HoX_3$, 70.0-71.0 wt % NaX, 2.0-4.0 wt % $ScX_3$, 0.1-0.5 wt % TlX and 20.0-30.0 wt % $HgX_2$ where X can be Br or I.

The short arc dimmable HID lamp with constant colour is provided wherein the arc tube is filled with the afore-mentioned chemical mix combined with aspect ratio ≧1.1.

The amount in which iodides/bromides of Ho, Na, Sc, Tl is used is such to achieve a Correlated Colour Temperature (CCT) in the range 3000-3500K, preferably about 3200K and $HgBr_2$ is added to avoid blackening of the lamp.

The electrical loading is 50-250 W/mm arc length and the wall loading is around 50-150 W/cm$^2$.

The lamp according to the present disclosure is suitable up to and above 4000 W.

BRIEF DESCRIPTION OF THE DRAWINGS

It is to be noted, however, that the appended drawings illustrate only typical embodiments of this disclosure and are therefore not to be considered for limiting of its scope, for the disclosure may admit to other equally effective embodiments.

DESCRIPTION OF THE PREFERRED EMBODIMENTS

Figure 1:
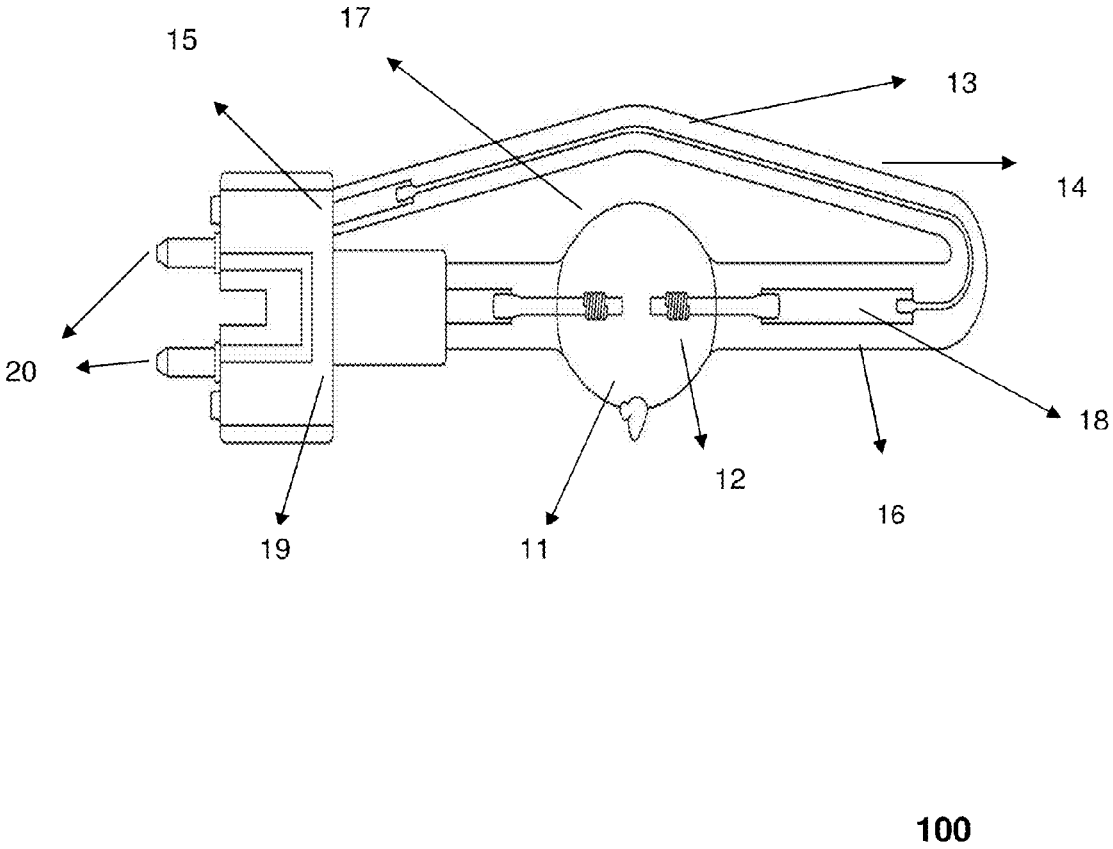
FIG. 1 shows a short arc dimmable HID lamp with constant colour during dimming, in accordance with the present disclosure.

Reference may be made to FIG. 1, which shows a single ended short arc metal halide lamp 100 without outer jacket, whose arc tube 11 has a specified aspect ratio and is equipped with a pair of tungsten electrodes 12. The lamp comprises a shroud 13 fused around the adjacent return lead 14, and a first center support 15. The arc tube (discharge vessel) 11 is filled with rare gas and chemical mix comprising at least the iodides and/or bromides of Sodium, Scandium, Holmium (Na—Sc—Ho) and optionally Tl and iodides and bromides of Hg. The arc tube (discharge vessel) has an ellipsoidal bulb shape. A seal 16 is equipped at the two ends of the ellipsoid 17 in each case. The arc tube (discharge vessel) 11 has the chemical mix described above. In the discharge vessel, a pair of electrodes of tungsten 12 with a free end longitudinal along the axis of symmetry are projected into the interior of the arc tube (discharge vessel) 11 from each seal 16. The electrodes 12 in each case are sealed in a vacuum tight fashion by a seal foil of molybdenum 18, electrically connected, with which the electrode 12 is welded, against the quartz of the seal 16.

At an end of the above said lamp, a single base 19 with two electrical contacts formed is connected over two contact pins 20 with a branch of the electric power supply in each case. The arc tube (discharge vessel) 11 and return lead 14 are held by the lamp base 19.

Figure 2:
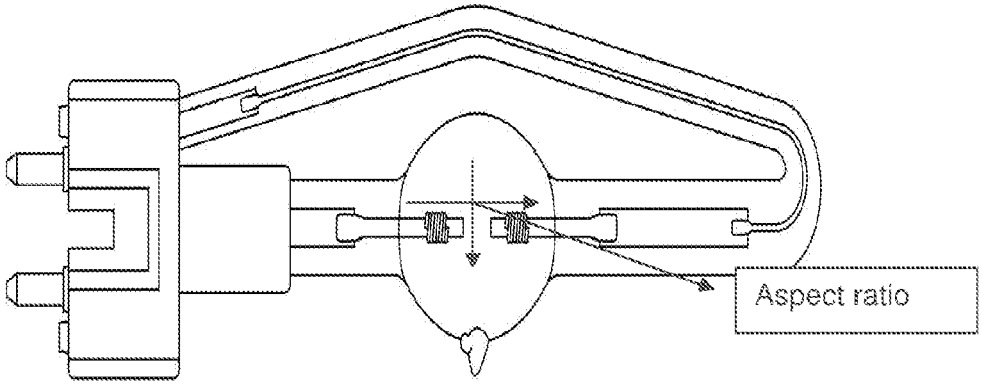
FIG. 2 shows schematic representations of arc tubes provided in accordance with the present disclosure.

FIG. 2 shows the aspect ratio (length of discharge space/diameter) of the arc tube. The use of the new chemical mix along with aspect ratio (length of discharge space/diameter)+/−1.4 in a short arc quartz HID lamp achieves the previously unachievable low colour temperature, high CRI and constant colour during life from a high loaded single ended short arc lamp. Thus the present disclosure increases useful life and lamp efficacy with reduction in heat output. The chemical mix is in the preferable range of 1.0-1.5 wt % $HoX_3$, 70.0-71.0 wt % NaX, 2.0-4.0 wt % $ScX_3$, 0.1-0.5 wt % TlX and 20.0-30.0 wt % $HgX_2$ where X can be Br or I.

The amount in which iodides/bromides of Ho, Na, Sc, Tl is used is such as to achieve a CCT of 3000-3500K, preferably about 3200K, and $HgBr_2$ is added to avoid blackening of the lamp. The electrical loading of the lamp is in the range of 100-175 watts per millimetre of arc length. The wall loading is around 50-150 W/cm$^2$.

Figure 3A:
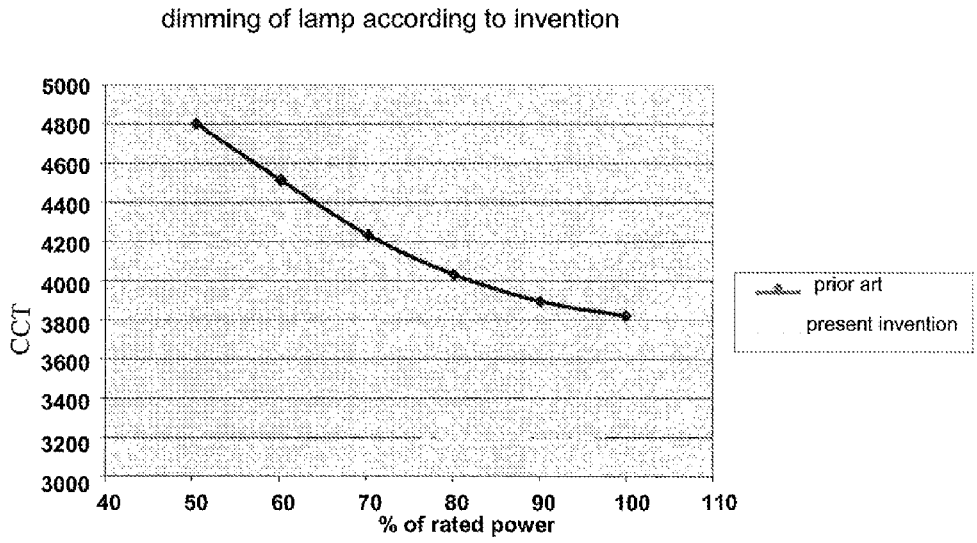
FIGS. 3*a* and 3*b* shows the graph between constant color temperature and dimming.
Figure 3B:
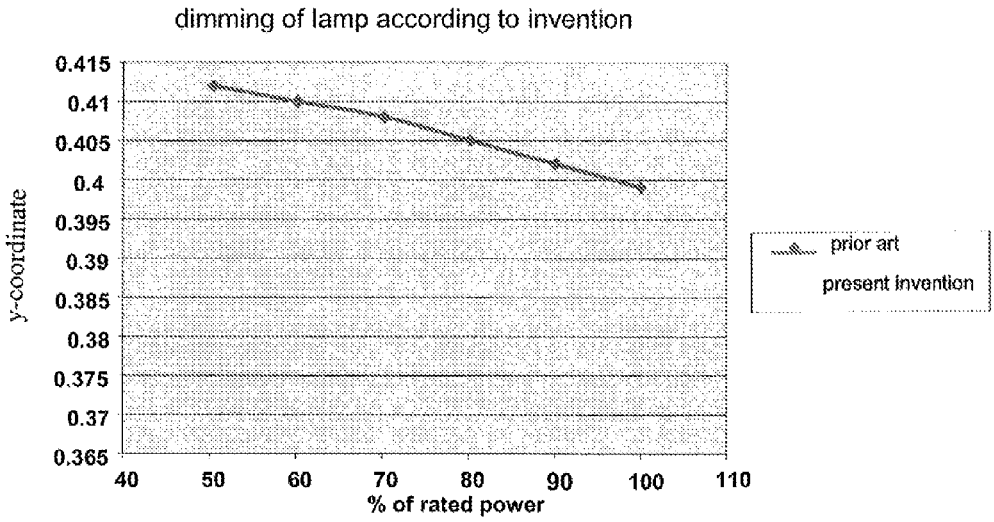

FIGS. 3*a* and 3*b* shows the graph between correlated color temperature (CCT in K) and dimming (in W) with respect to the power of the lamp (in W) and Y-coordinate of the colour. From the graph it is clear that colour temperature with respect to the power of the lamp and Y-coordinate of the colour during dimming remains more or less constant. This is achieved by the perfect combination of chemical mix comprising halides such as iodides and/or bromides of Na—Sc—Ho and optionally also Tl, wall loading and lamp dimensions (aspect ratio). For various lamps different values for the above mentioned variables, CCT is measured as a function of power. Parameters are optimized to have a curve that is as flat as possible—only very small change in CCT if power changes. Also the Y value of the colour coordinates remains more or less stable. In the prior art, if metal halide lamps are dimmed, the colour temperature goes up and they acquire a greenish colour resulting in a higher Y-value.

It is to be noted that the present disclosure is susceptible to modifications, adaptations and changes by those skilled in the art. Such variant embodiments employing the concepts and features of this disclosure are intended to be within the scope of the present disclosure, which is further set forth under the following claims.

We claim:

1. A short arc dimmable HID lamp comprising:

a quartz arc tube with at least one Tungsten electrode; and a discharge region having an aspect ratio of ≧1.1, wherein the discharge region contains a chemical mix comprising iodides and/or bromides of Sodium, Scandium, Holmium (Na—Sc—Ho) and wherein the chemical mix is in the range of 0.75-2 wt % $HoX_3$, 45-85 wt % NaX, 1.5-5.5 wt % $ScX_3$, where X can be Br or I.

2. The short arc dimmable HID lamp as claimed in claim 1, wherein the chemical mix optionally includes halides of Thallium (Tl).

3. The short arc dimmable HID lamp as claimed in claim 1, wherein the chemical mix optionally includes iodides or bromides of Mercury (Hg) to avoid the blackening of the lamp.

4. The short arc dimmable HID lamp as claimed in claim 1, wherein an emission color stays approximately constant when the lamp is dimmed.

5. The short arc dimmable HID lamp as claimed in claim 1, wherein the chemical mix is in the range of 0.75-2 wt % $HoX_3$, 45-85 wt % NaX, 1.5-5.5 wt % $ScX_3$, 0.1-1 wt % TlX and 10-50 wt % $HgX_2$, where X can be Br or I.

6. The short arc dimmable HID lamp as claimed in claim 1, wherein the chemical mix is in the range of 1.0-1.5 wt % $HoX_3$, 70.0-71.0 wt % NaX, 2.0-4.0 wt % $ScX_3$, 0.1-0.5 wt % TlX and 20.0-30.0 wt % $HgX_2$ where X can be Br or I.

7. The short arc dimmable HID lamp as claimed in claim 4, wherein the lamp is dimmed from about 100% of its rated power to about 75% of its rated power and the emission color remains about 3200K.

8. The short arc dimmable HID lamp as claimed in claim 1, wherein the arc tube is disposed within an ultraviolet stop shroud.

9. The short arc dimmable HID lamp in claim 1, wherein an electrical loading is 50-250 W/mm arc.

10. The short arc dimmable HID lamp as claimed in claim 1, wherein a wall loading is 50-150 $W/cm^2$.

* * * * *